US007507104B1

(12) United States Patent
Brigham, Jr. et al.

(10) Patent No.: US 7,507,104 B1
(45) Date of Patent: Mar. 24, 2009

(54) MATING FOR SINGLE CONNECTOR ATTACHMENT (SCA) DISK CONNECTORS

(75) Inventors: Joseph L. Brigham, Jr., North Attleboro, MA (US); Albert F. Beinor, Jr., Sutton, MA (US); Joseph P. King, Jr., Sterling, MA (US)

(73) Assignee: EMC Corporation, Hopkinton, MA (US)

( * ) Notice: Subject to any disclaimer, the term of this patent is extended or adjusted under 35 U.S.C. 154(b) by 0 days.

(21) Appl. No.: 11/418,363

(22) Filed: May 4, 2006

(51) Int. Cl.
*H01R 13/62* (2006.01)

(52) U.S. Cl. ..... 439/374

(58) Field of Classification Search ..... 439/374, 439/405, 375, 456, 492
See application file for complete search history.

(56) References Cited

U.S. PATENT DOCUMENTS 5,356,300 A 10/1994 Costello et al.
5,547,385 A * 8/1996 Spangler ..... 439/101
6,071,150 A * 6/2000 Tang et al. ..... 439/638
6,315,615 B1 * 11/2001 Raistrick ..... 439/637
6,381,130 B1 * 4/2002 Yen ..... 361/685
7,114,963 B2 * 10/2006 Shuey et al. ..... 439/79
2004/0023531 A1 2/2004 Wu

OTHER PUBLICATIONS

Circuit Assembly; "SCA2 Connectors"; Single Connector Attachment, 2nd Version; http://www.circuitassembly.com; 6 pgs.

* cited by examiner

*Primary Examiner*—T C Patel
*Assistant Examiner*—Phuong Nguyen
(74) *Attorney, Agent, or Firm*—Guerin & Rodriguez, LLP; Michael A. Rodriguez

(57) ABSTRACT

Described is a single connector attachment (SCA) connector that improves blind mating between plug and receptacle SCA connectors. The SCA connector has an insulative shell with opposing end walls and opposing sidewalls. The end walls and sidewalls define a substantially rectangular recess within which a plurality of electrical contacts is disposed. One of the end walls of the shell has a chamfer. The slope of the chamfer enables plug and receptacle SCA connectors to continue coming together although their respective housings may come against each other before the alignment guiding features of the SCA connectors are able to achieve alignment.

15 Claims, 7 Drawing Sheets

MATING FOR SINGLE CONNECTOR ATTACHMENT (SCA) DISK CONNECTORS

FIELD OF THE INVENTION

The invention relates generally to electrical connectors. More particularly, the invention relates to improved mating for single connector attachment (SCA) disk connectors.

BACKGROUND

Fibre Channel is an electrical interface standard used to interconnect devices physically. Various types of electrical connectors can be used in support of Fibre Channel. One type is a single connector attachment (SCA) connector. One SCA connector connects a Fibre Channel disk drive directly to a midplane or backplane of a storage enclosure and carries the command signaling, power input signals, and outputs required by the disk drive. Typically, the disk drive has a plug (male) SCA connector that mates with a receptacle (female) SCA connector on the midplane. The current version of SCA is SCA-2, and the SFF (Small Form Factor) Committee standard SFF-8451 governs the SCA-2 connector interface.

FIG. 1 shows a prior art receptacle SCA connector 10 about to mate with a plug SCA connector 12. At opposite ends of the receptacle SCA connector 10 are alignment guides 14-1, 14-2 (generally, 14). Each alignment guide 14 receives a respective alignment post 16-1, 16-2 when the plug and receptacle SCA connectors join. The alignment guides 12 facilitate blind mating, that is, a user can connect a disk drive to the midplane without needing to see either the plug or receptacle SCA connector.

The plug and receptacle SCA connectors each have a respective D-shaped housing 18, 20 with one or more rows of contacts (or pins) disposed therein (not shown). Normally, the housing 18 of the plug SCA connector closely receives the housing 20 of the receptacle SCA connector. Under certain conditions, however, the plug and receptacle SCA connectors will not mate, although all physical features of the plug and receptacle SCA connectors, and the delivery system (e.g., drive bay) that joins them, conform to the SCA-2 industry standard for SCA connectors. For example, when the angle of plugging a disk drive into a midplane slightly diverges from perpendicular relative to the midplane, the plug and receptacle SCA connectors can bind before their contacts regions are able to mate. More specifically, the housings 18, 20 of the plug and receptacle connectors may collide (at point 22) before the alignment guides 12 are able to align the plug SCA connector properly with respect to the receptacle SCA connector.

SUMMARY

In one aspect, the invention features a single connector attachment (SCA) connector comprising an insulative shell having opposing end walls and opposing sidewalls. The end walls and sidewalls define a substantially rectangular recess within which a plurality of electrical contacts is disposed. One of the end walls of the shell has a chamfer.

In another aspect, the invention features a storage system comprising a midplane and one or more single connector attachment (SCA) connectors connected to the midplane. Each SCA connector includes an insulative shell with opposing end walls and opposing sidewalls. The end walls and sidewalls define a substantially rectangular recess within which a plurality of electrical contacts is disposed. One of the end walls of the shell has a chamfer.

BRIEF DESCRIPTION OF THE DRAWINGS

The above and further advantages of this invention may be better understood by referring to the following description in conjunction with the accompanying drawings, in which like numerals indicate like structural elements and features in various figures. The drawings are not necessarily to scale, emphasis instead being placed upon illustrating the principles of the invention.

DETAILED DESCRIPTION

Receptacle SCA connectors constructed in accordance with the present invention include a chamfer at one or both ends of the insulative shell that houses the electrical contacts and mates with the contact housing of a plug SCA connector. In general, the chamfer is a beveled edge at an end of the shell. In one embodiment, the chamfer alters the radius of the D-shape of a standard receptacle SCA connector. This change of the D-shape facilitates mating, particular blind mating, between the plug and receptacle SCA connectors.

In general, SCA-2 standards, e.g., SFF-8451 for 40- and 80-pin SCA connectors and draft standard SFF-8053i for 20-pin SCA connectors, specify the size, length, width, height, board mounting, pin location, and specific mating features. Such standards provide some latitude that allows suppliers to distinguish their SCA connector from other connectors: not all features of SCA connectors are covered. For example, the radius of the D-shaped shell (one at each end) is a feature that the SCA-2 standards do not specify (and, thus, typically varies from supplier to supplier). Accordingly, the receptacle SCA connectors of the invention conform to the relevant SCA-2 standard since the chamfers modify a non-standardized feature. Further, receptacle SCA connectors of the invention can be used with standard SCA-2 compliant plug SCA connectors.

Figure 1:
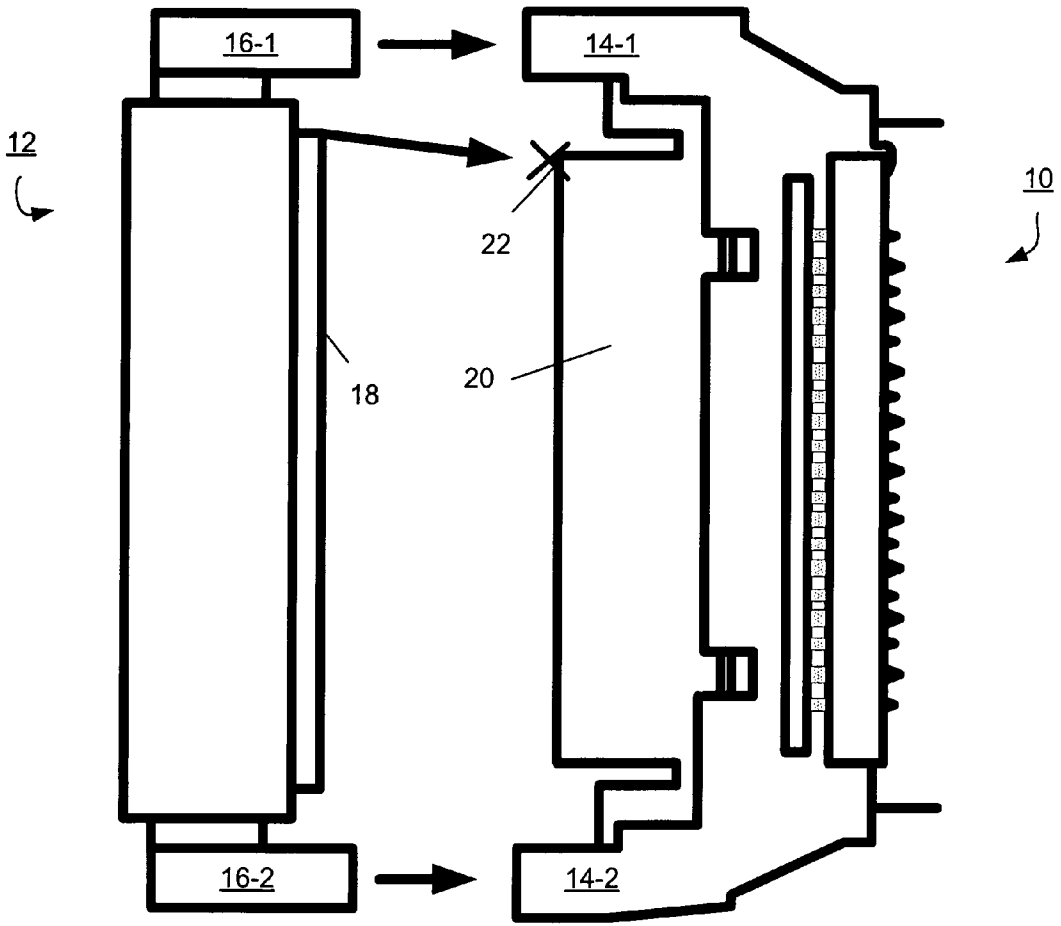
FIG. 1 (Prior Art)
FIG. 1 is a side view of a prior art receptacle SCA connector about to mate with a prior art plug SCA connector.
Figure 2:
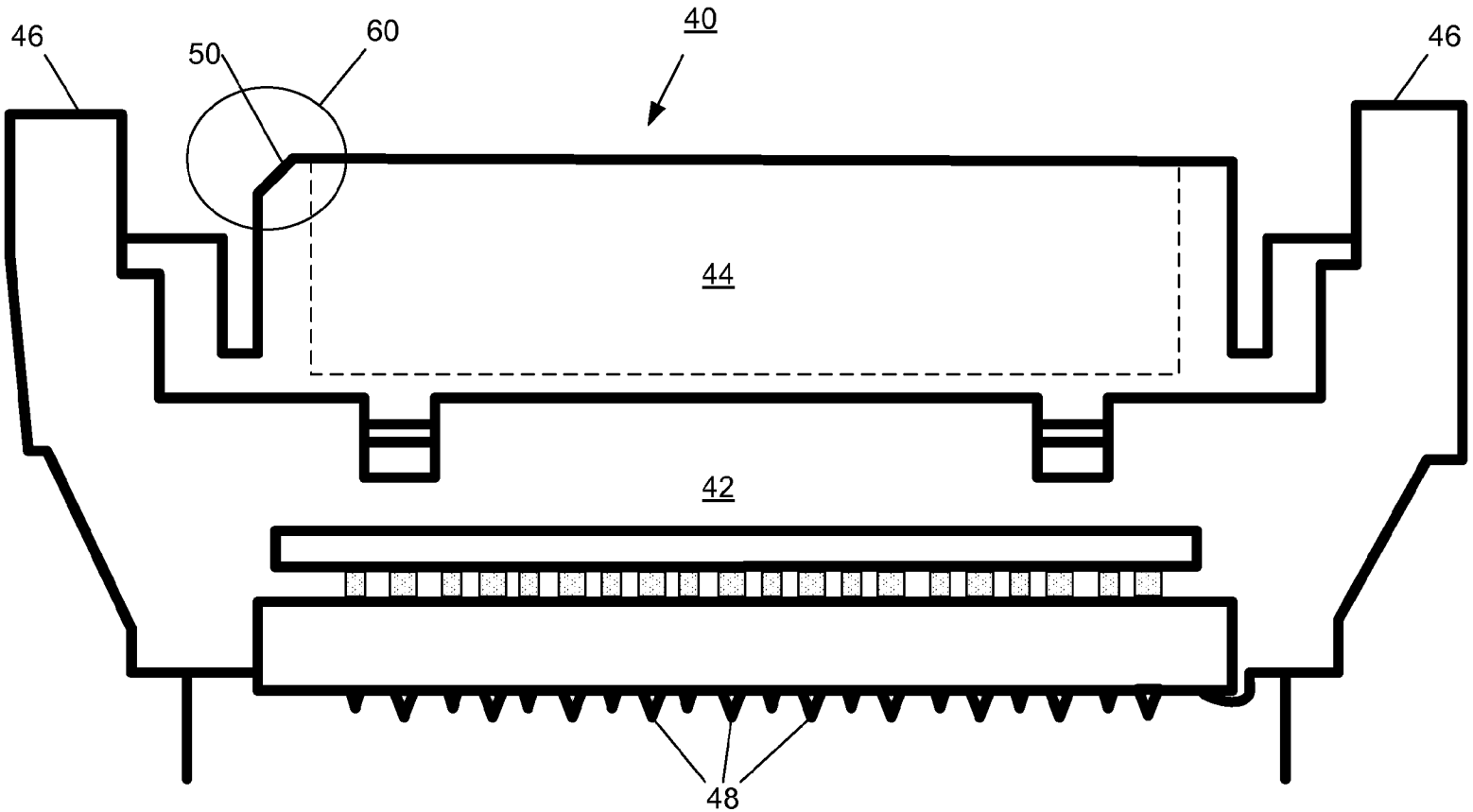
FIG. 2 is a side view of an embodiment of a receptacle SCA connector constructed in accordance with the invention, with a chamfer at one end of a D-shaped shell or housing.

FIG. 2 shows a side view of an embodiment of a receptacle SCA connector 40 constructed in accordance with the invention. The receptacle SCA connector 40 includes a connector body 42 and an insulative shell or housing 44. The connector body 42 has an alignment guide 46 at each end of the connector 40. The insulative shell 44 has a recess (shown in phantom) that houses a plurality of contacts, here seen extending through the connector body 42 and emerging as pins 48. In this embodiment, there are 20 pins. Other embodiments can have fewer or more (e.g., 40, 80) than 20 pins, without departing from the principles of the invention.

At one end of the insulative shell 44 is a chamfer 50. The slope of the chamfer 50 prevents the insulative shell 44 of the receptacle SCA connector 40 from binding if the shell 44 comes against the housing of the plug SCA connector during mating. As a result, the insulative shell 44 can enter the housing of the plug SCA connector sufficiently far to allow the alignment posts of a plug SCA connector to engage the alignment guides 46 of the receptacle SCA connector and thus align the SCA connectors for proper mating.

Figure 3:
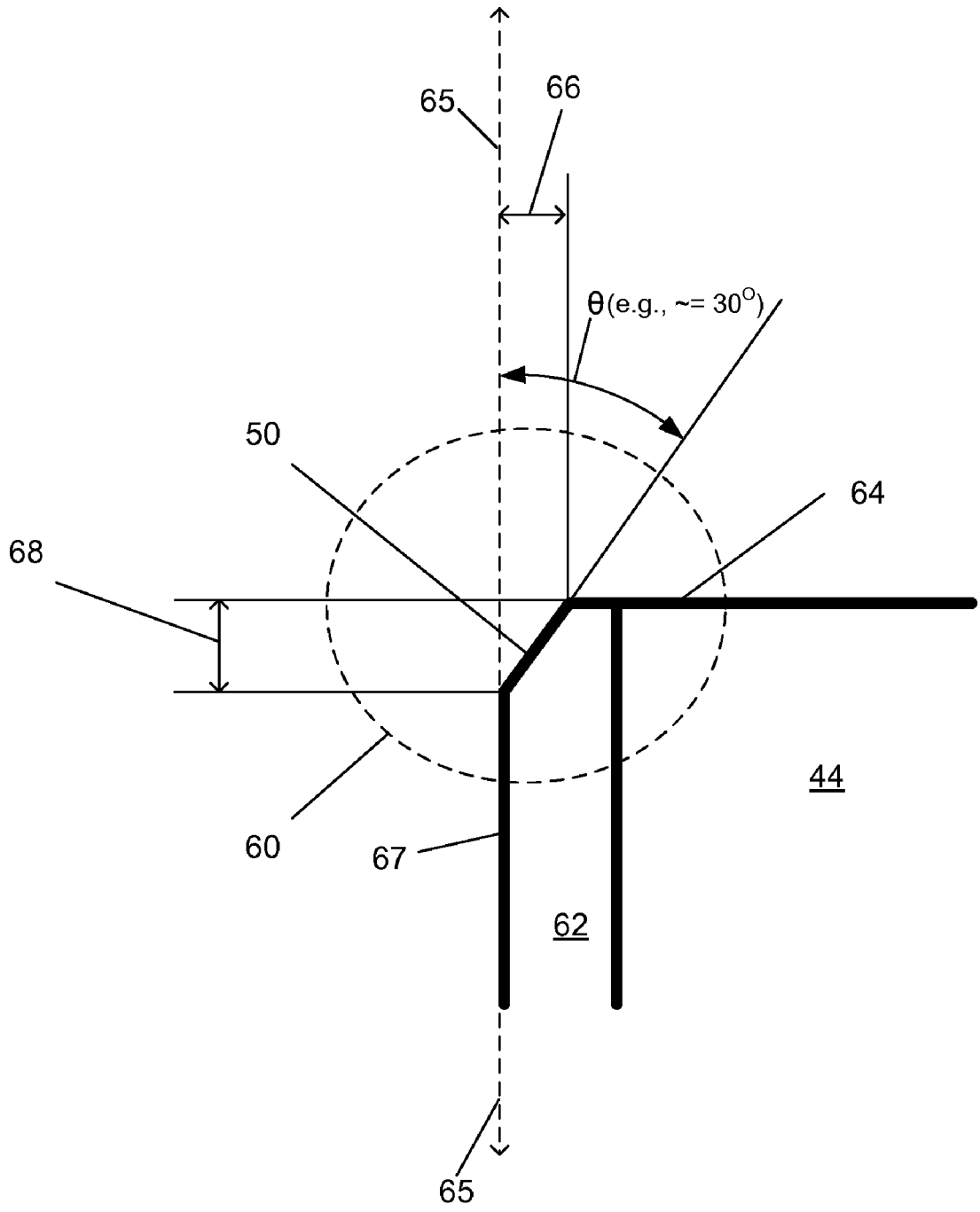
FIG. 3 is a side view of the chamfer in closer detail.

FIG. 3 shows a side view of the chamfer 50 in closer detail. The chamfer 50 is disposed at a corner region (shown within a circle 60 in FIG. 2) of the insulative shell 44, at a juncture of an end wall 62 and a top edge 64 of the insulative shell 44. The chamfer 50 is at an angle θ with respect to a plane 65 defined by an outer side surface 67 of the end wall 62. The plane 65 is illustrated as a dashed line with double-headed arrows extending tangential to the outer side surface 67 of the end wall 62. In one embodiment, the angle θ is approximately 30 degrees. Angles other than 30 degrees can be used in the practice of the invention, provided the chamfer 50 has sufficient slope to prevent the insulative shell 44 from binding, as described above. In one embodiment, the chamfer 50 is 1 mm×2 mm in dimension. More specifically, the chamfer 50 "cuts away" approximately 1 mm (denoted by reference numeral 66) of the top edge 64 and 2 mm (denoted by reference numeral 68) of the end wall 62.

Figure 4:
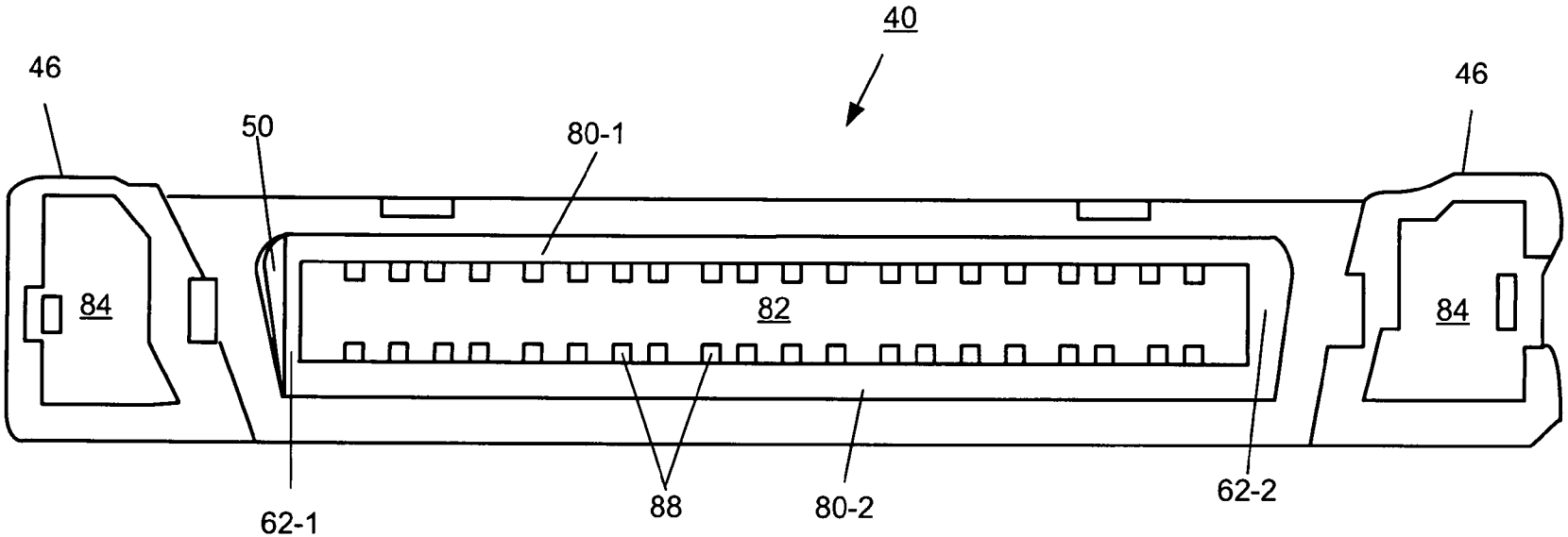
FIG. 4 is a top view of the receptacle SCA connector of FIG. 2.
Figure 5:
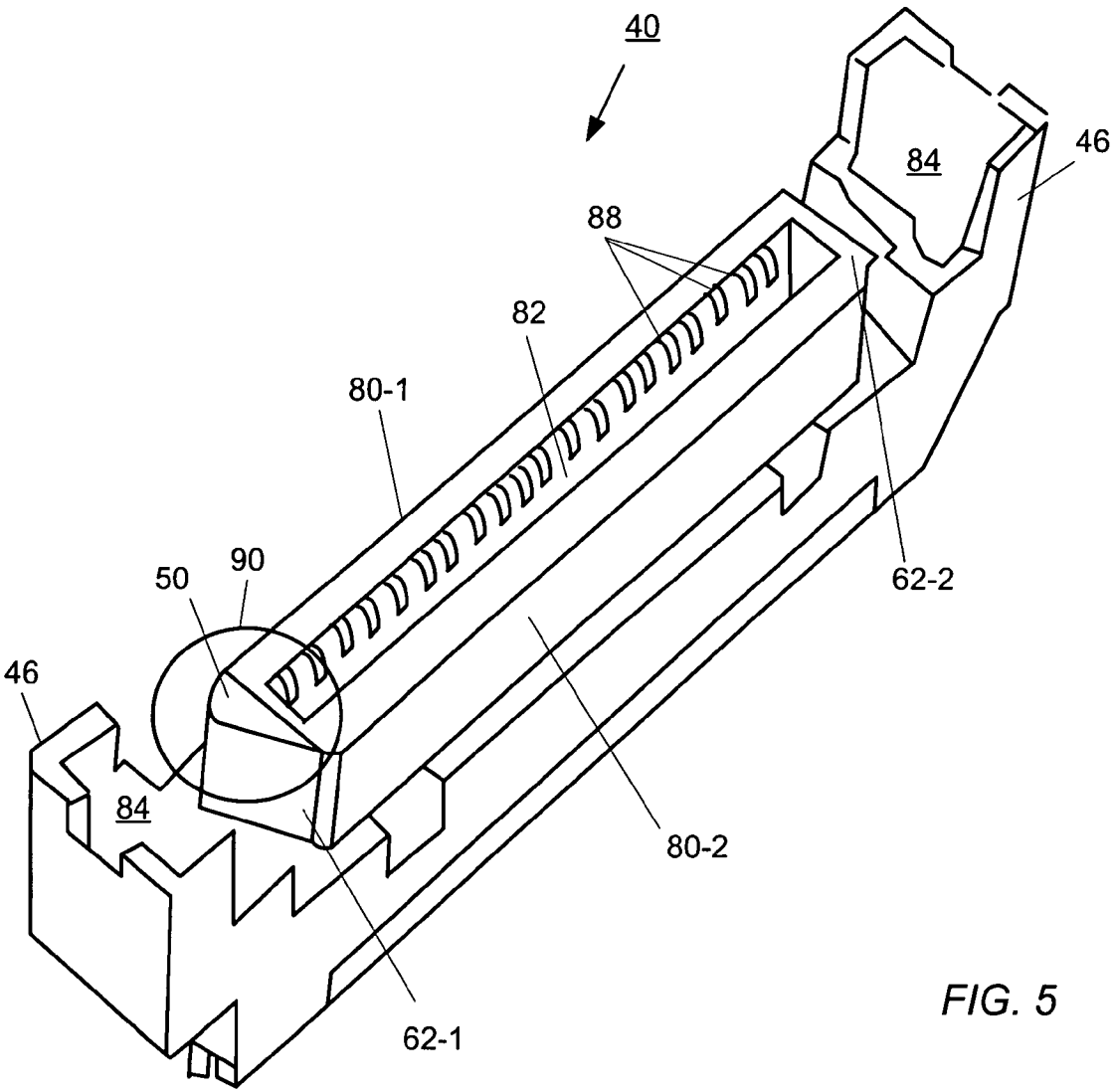
FIG. 5 is a perspective view of the receptacle SCA connector of FIG. 2.

Referring now to FIG. 4 and FIG. 5, FIG. 4 shows a top view of the receptacle SCA connector 40 of FIG. 2, with the D-shaped insulative shell 44 and alignment guides 46, and FIG. 5 shows a perspective view of the receptacle SCA connector 40. The insulative shell 44 has opposing end walls 62-1, 62-2 (generally, 62) and opposing sidewalls 80-1, 80-2 (generally, 80). The end walls 62 and sidewalls 80 define a generally rectangular recess 82 within which are disposed the contacts 88. Each end wall 62 has a curved edge (corresponding to the curved ends of the D-shaped shell 44). Here, the end wall 62-1 has the chamfer 50, which cuts into curved edge of that end wall. Each alignment guide 46 has a recess 84 for receiving an alignment post of a plug SCA connector.

Figure 6:
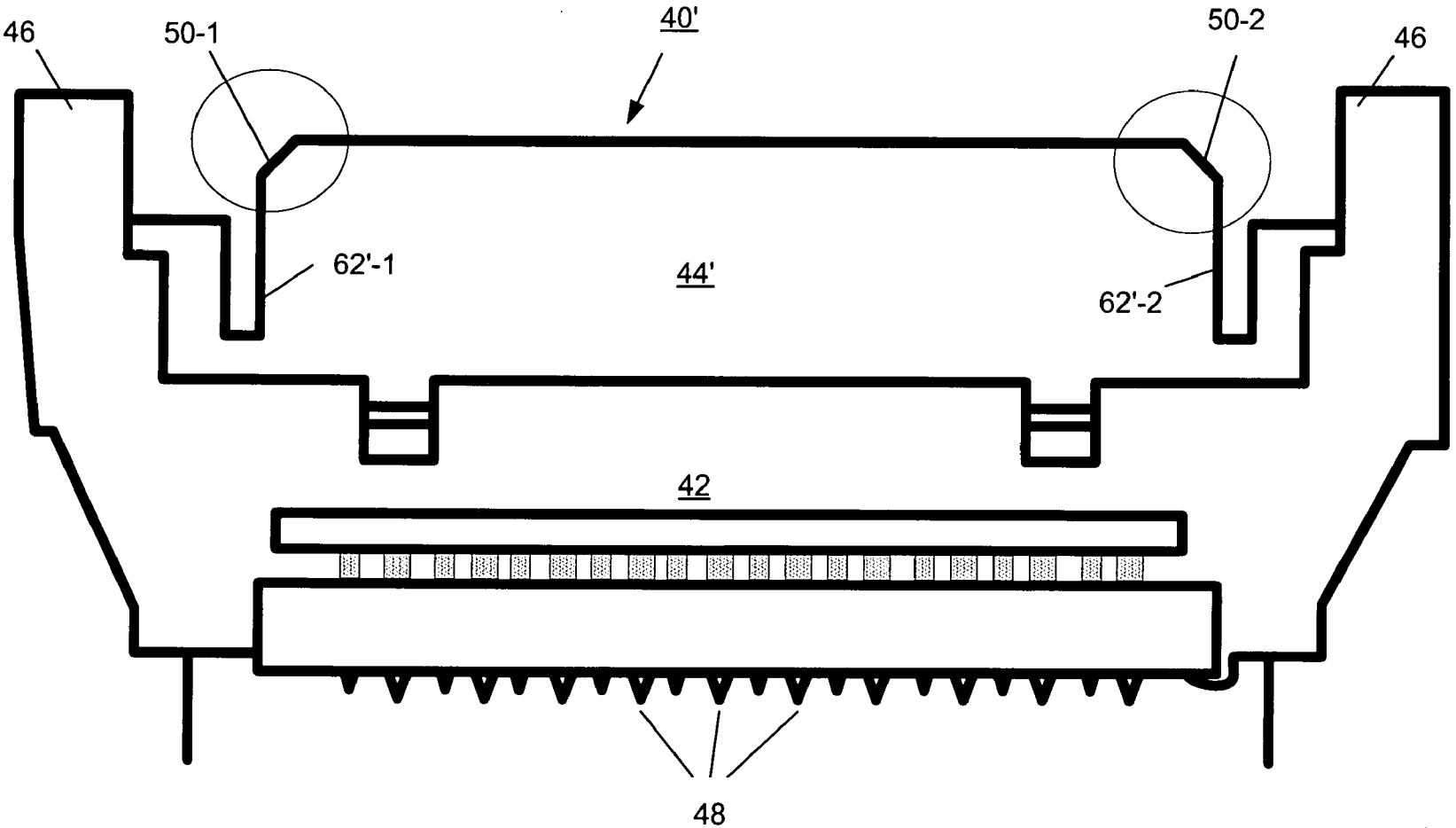
FIG. 6 is a side view of another embodiment of a receptacle SCA connector constructed in accordance with the invention.

FIG. 6 is a side view of another embodiment of a receptacle SCA connector 40' constructed in accordance with the invention. The receptacle SCA connector 40' is similar in construction to the receptacle SCA connector 40 of FIG. 2. One difference: the receptacle SCA connector 40' has a plurality of chamfers 50-1, 50-2, whereas the receptacle SCA connector 40 has only one. For the receptacle SCA connector 40', each end wall 62'-1, 62'-2 has a respective chamfer 50-1, 50-2. By having a chamfer at each end of the shell 44', the receptacle SCA connector 40' is symmetric and, thus, can accommodate misalignment of the plug SCA connector at either end.

Figure 7:
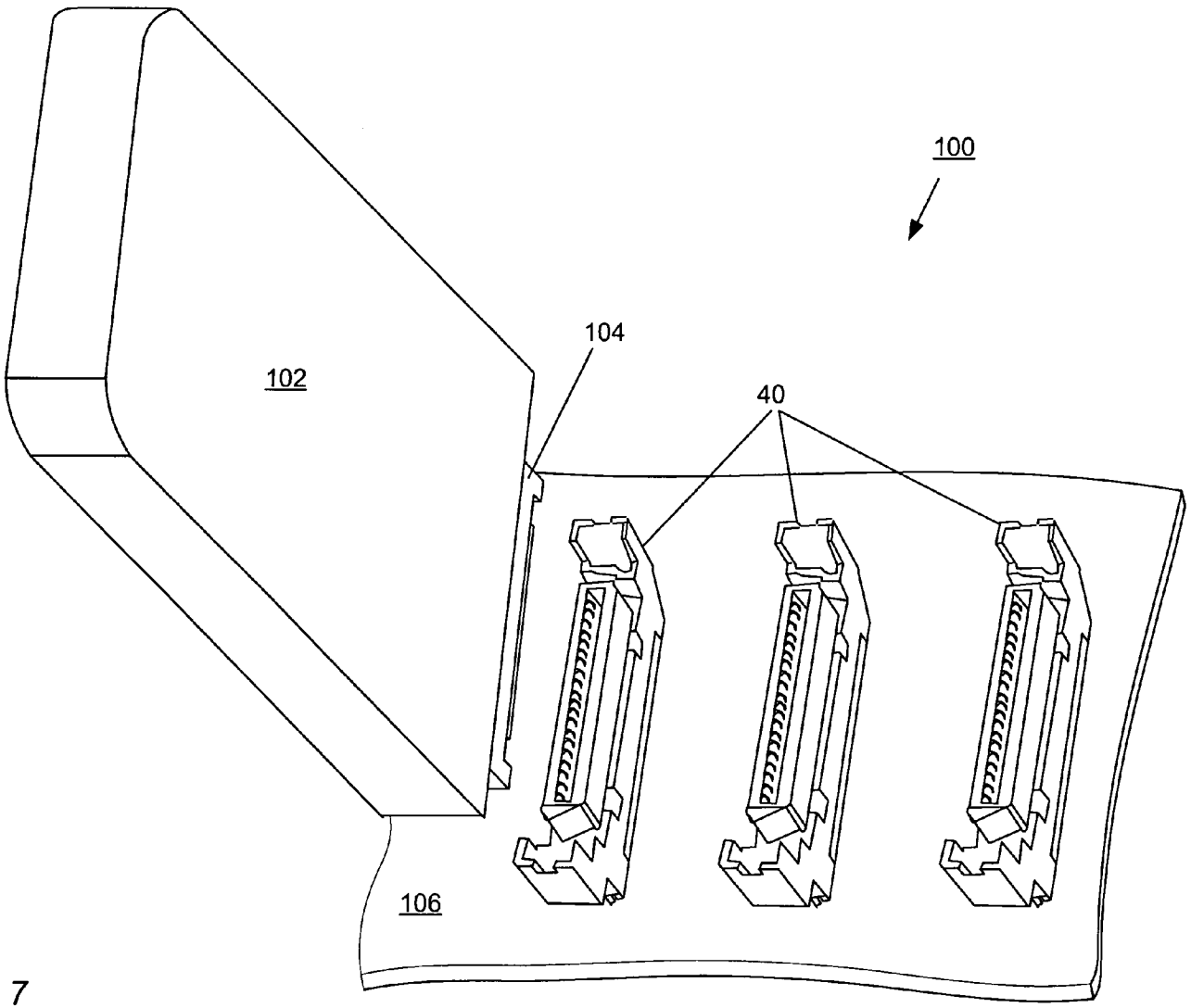
FIG. 7 is a perspective view of a disk drive with a plug SCA connector about to connect to one of a plurality of receptacle SCA connectors on a midplane.

FIG. 7 shows a data storage environment 100 in which receptacle SCA connectors constructed in accordance with the invention may be used. The data storage environment 100 includes an enclosure (not shown), at least one disk drive 102 with a plug SCA connector 104, here, about to connect to one of a plurality of receptacle SCA connectors 40 mounted to a midplane 106 by way of a delivery system (not shown), e.g., a drive storage bay. As another exemplary environment, the plug SCA connector 104 can be incorporated in a hard drive for use in a personal computer, and the receptacle SCA connector 40 mounted to a motherboard.

While the invention has been shown and described with reference to specific preferred embodiments, it should be understood by those skilled in the art that various changes in form and detail may be made therein without departing from the spirit and scope of the invention as defined by the following claims. For example, as described herein, receptacle SCA connectors are mounted on a backplane or midplane and plug SCA connectors are incorporated into hard drives or disk drives, however, such roles can be reversed without departing from the principles of the invention.

What is claimed is:

1. A single connector attachment (SCA) connector comprising an insulative shell having opposing end walls and opposing sidewalls, the end walls and sidewalls defining a substantially rectangular recess within which a plurality of electrical contacts is disposed, one of the end walls of the shell having a chamfer at a top edge of that end wall, the chamfer having a planar surface that extends at a constant slope from the top edge of that end wall to an outer side surface of that one end wall.

2. The SCA connector of claim 1, wherein the planar surface of the chamfer is approximately at a 30 degree angle with respect to a plane defined by the outer side surface of that end wall.

3. The SCA connector of claim 1, wherein the chamfer is approximately 1 mm by 2 mm in dimension.

4. The SCA connector of claim 1, wherein the other of the end walls of the shell has a chamfer.

5. The SCA connector of claim 1, wherein the shell is D-shaped.

6. The SCA connector of claim 1, wherein the SCA connector is a receptacle connector.

7. The SCA connector of claim 1, wherein the SCA connector conforms to an SCA-2 standard.

8. A storage system comprising:

a midplane; and one or more single connector attachment (SCA) connectors connected to the midplane, each SCA connector including an insulative shell with opposing end walls and opposing sidewalls, the end walls and sidewalls defining a substantially rectangular recess within which a plurality of electrical contacts is disposed, one of the end walls of the shell having a chamfer at a top edge of that one end wall, the chamfer having a planar surface that extends at a constant slope from the top edge of that one end wall to an outer side surface of that one end wall.

9. The storage system of claim 8, wherein the planar surface of the chamfer is approximately at a 30 degree angle with respect to a plane defined by the outer side surface of that one end wall.

10. The storage system of claim 8, wherein the chamfer is approximately 1 mm by 2 mm in dimension.

11. The storage system of claim 8, wherein the other of the end walls of the shell has a chamfer.

12. The storage system of claim 8, wherein the SCA connector is a receptacle connector.

13. The storage system of claim 8, wherein each SCA connector conforms to a SCA-2 standard.

14. The storage system of claim 8, wherein the shell is D-shaped.

15. The storage system of claim 8, further comprising a disk drive with a plug SCA connector that mates with one of the receptacle SCA connectors, the plug SCA connector conforming to a SCA-2 standard.

* * * * *